United States Patent [19]

Morganroth

[11] 4,114,632

[45] Sep. 19, 1978

[54] METHOD OF SELECTIVELY ALTERING HAIR COLOR

[76] Inventor: Shila Morganroth, 1225 Waterbury Rd., Highland, Mich. 48031

[21] Appl. No.: 579,012

[22] Filed: May 19, 1975

Related U.S. Application Data

[63] Continuation-in-part of Ser. No. 481,695, Jun. 14, 1974.

[51] Int. Cl.[2] ..... A45D 7/04; A61K 7/13; A61K 7/135

[52] U.S. Cl. ..... 132/7; 8/10.2; 8/11; 8/32; 424/DIG. 3; 424/62

[58] Field of Search ..... 132/7; 8/10.1, 10.2, 8/11, 32, 111; 424/62; 427/154, 259

[56] References Cited

U.S. PATENT DOCUMENTS

| | | | |
|---|---|---|---|
| 2,617,431 | 11/1952 | Gaspari | 132/11 |
| 2,819,721 | 1/1958 | Zakon | 132/7 |
| 2,957,480 | 10/1960 | Widoff et al. | 132/7 |
| 3,289,679 | 12/1966 | Zellerman | 132/7 |
| 3,349,781 | 10/1967 | Poole et al. | 132/7 |
| 3,429,642 | 2/1969 | Underwood | 401/16 |
| 3,433,232 | 3/1969 | Garrett | 132/7 |
| 3,570,499 | 3/1971 | Ruta | 132/9 |
| 3,749,105 | 7/1973 | Sestita | 132/7 |
| 3,892,845 | 7/1975 | Cunningham et al. | 424/62 |

OTHER PUBLICATIONS

Rohrer, Rohrer's Scientific Modern Beauty Culture, Prof. Rohrer's Institute of Beauty Culture, New York, (1924), pp. 10–14.

Redgrove et al., Hair-Dyes and Hair-Dyeing, Chemical Publishing Co., New York, (1939), pp. 137–142 and 147–158.

Colletti, Cosmetology–The Keystone Guide to Beauty Culture, Sheridan House, Inc., New York (1970), pp. 105–125.

Redgrove et al., II, Hair-Dyes and Hair-Dyeing, Chemical Publishing Co., New York, (1939), pp. 176–177.

*Primary Examiner*—Albert T. Meyers
*Assistant Examiner*—Vera C. Clarke
*Attorney, Agent, or Firm*—George H. Mortimer

[57] ABSTRACT

Methods of selectively altering hair color for simulating natural highlights, for in depth streaking, for producing special effects for versatile hair styling by polygonal partings, and for producing frosting and tipping without the pain of pulling hair through a perforated cap.

Methods of coloring mens' hair, on the head and on the face, using protective measures to prevent damage to eyes, nose and mouth.

13 Claims, No Drawings

METHOD OF SELECTIVELY ALTERING HAIR COLOR

This application is a continuation-in-part of my prior application Ser. No. 481,695 filed June 14, 1974.

INTRODUCTION

The present invention relates to methods of altering hair color selectively and to packages for use in these methods. The methods have the purpose of producing hair of variegated colors, preferably in the same color family, by spreading a hair treating liquid onto, and in some cases into, strands or tresses or polygons of hair to produce the different colors or hues. The hair treating methods of the invention include hair highlighting, hair painting, and hair streaking with a highly viscous bleach and with milder readily flowable bleach materials that may be safely used against the scalp; hair coloring such as hair tinting and hair toning; hair shading; hair frosting; hair tipping and the like. The word "liquid" as used herein is intended to be broad enough to include any spreadable material even if it will not flow readily because of high viscosity. The packages are designed to provide in one container all the materials needed for a particular method.

BACKGROUND OF THE INVENTION

Hair treatment, including hair coloring, is an ancient art. The oldest available records show that women then, as now, were not satisfied with their natural hair coloring and used available materials in an attempt to obtain a hair color which they considered more desirable than nature had provided. Among other coloring materials that were used anciently are henna, a red vegetable dye; indigo; sage; and camomile. Dark haired women in the time of Rome's zenith, who admired the blond hair of female slaves brought from northern Europe, used saffron, red arsenic, nut shells and plant ash to bleach their hair. Later it was found that if the hair was wet with soap and exposed to the sun it would lighten. Mixtures of alum, black sulfur and honey have also been used as lightening agents. In the latter part of the 19th century synthetic dyes, particularly paraphenylenediamine, were developed and offered for hair coloring, either alone or in admixture with metallic salts. Oxidizing agents, particularly hydrogen peroxide, came into rather widespread use as the bleacing agent to lighten hair.

Until relatively recent times little was known and understood about the structure of hair and the mechanics of hair coloring. Through microscopic study of the hair it has been determined that a typical hair shaft, the part of the hair outside the hair follicle where the hair is formed, comprises an outer sheath of scales called the cuticle, the main body of the hair called the cortex and a slender central filament called the medulla.

The scales of the cuticle are plate-like in shape and cover the cortex somewhat in the same general manner that shingles cover the roof where the root of the hair corresponds to the eaves. This arrangement of the scales permits the hair to be combed from the scalp outward without damage to the cuticle, just as water can flow down a roof that is well shingled without causing leakage, whereas brushing or combing the hair toward the scalp tends to damage the cuticle just as a stream of water directed upwardly on a roof could easily cause leakage by penetration between the shingles and, if the force of the upwardly directed stream is strong enough, the shingles could be lifted and even torn from the roof. Being transparent, and colorless, the scale cells of the cuticle are not altered in color by bleaching agents but they must be altered structurally so as to permit the coloring solutions to pass through the cuticle and penetrate the cortex and the cuticle may be subjected to damage if the treating liquids are improperly used.

The cortex is composed of elongated cells, rather typical of fibers, comprised of complex proteins among which all the pigments that give the hair its color are found. Pigments are of different colors, such as yellow, red, brown, black, etc., and in general a hair shaft will contain pigment cells of several different colors. Pigments of different colors are affected differently by bleach and lightening solutions. In general such solutions attack the darker colors first and it has been found useful to divide the bleaching or lightening process from black to very light hair in stages which are referred to as follows:

Stage 1 — black
Stage 2 — brown
Stage 3 — red
Stage 4 — red-gold
Stage 5 — gold
Stage 6 — yellow
Stage 7 — pale yellow
Stage 8 — white Bleaching and lightening liquids, however, affect not only the pigment cells but also other cells of the hair and some chemical bleachants under some conditions may have a variety of adverse effects on the structural part of the hair, e.g., seriously weaken or embrittle the hair so that it will break off in wet or dry condition; cause hair to lose its normal springiness or resilience when highly bleached (to Stage 7 or 8) so that in wet condition it feels like sponge or rubber, will stretch like a thin rubber filament if pulled, will break if stretched beyond the elastic limit, and in dry condition it is brittle and snaps off if bent; and reduce the ability of the hair to take up color in the normal manner. In many cases the scalp may also be deleteriously affected by contact for too long a period of time with the bleachants used on the hair.

The medulla is not always present and is of little importance in coloring and otherwise treating the hair.

Hair coloring of the permanent type as practiced today may be carried out (a) in two operations which are frequently referred to as (1) bleaching or prelightening and (2) tinting, toning, or coloring, or (b) in some cases, in a single operation which comprises bleaching or lightening the natural pigments and simultaneously depositing other pigments in the cortex of the hair. The one step process was not introduced in the market place until about 1950 after which it became very popular but it has not completely displaced the two step process which is still necessary if a person desires to change the color of the hair through several stages of lightening.

Permanent hair coloring is somewhat of a misnomer because no known process of hair coloring is able to affect the natural color of new hair that grows out after a so-called permanent color is applied. This new growth adjacent to the scalp is referred to in the hair coloring art as the "roots" and they present numerous continual problems for the very reason that they are not affected by permanent hair colloring applied to the shaft of the hair before the emergence of the new growth. The word "Permanent" as used in this art means only that the color which is applied to the then existing shaft of the hair is not washed out with shampoo and water. The most popular way of obtaining permanent hair coloring is by the use of penetrating tints or dyes which deposit pigment in the cortex of the hair shaft. It is possible, however, to apply a coating tint on the cuticle layer but this produces an unnatural look that most persons consider far less satisfactory than the appearance obtained by the use of a penetrating tint.

Semipermanent hair coloring differs from the permanent type in that it will wash out but requires several shampooings before all the color is removed. It is used primarily either to color gray hair without changing the color of the remaining pigmented hair or to make gray hair a color that the person prefers to a natural gray. In general the coloring materials used to obtain semipermanent hair coloring are the penetrating type but they are gentler on the tissues and require no peroxide developer.

Temporary hair colorings differ from the permanent and semipermanent colorings in that they deposit color on the cuticle of the hair shaft, have no lasting effect on the hair color and are washed out by shampooing. In general temporary hair coloring materials are either rinses, highlighting shampoos or materials that can be applied to the hair in the form of powders, creams or sprays.

Hair treating materials that are applied to the hair as a liquid in accordance with the invention may be any of these types:

(a) a single material which is normally liquid within the temperature used for hair treating, (b) a solution of one or more materials in a liquid vehicle, including true solutions (single phase), colloidal solutions, emulsions of one liquid in another, and (c) suspensions of a finely divided solid material In a carrier liquid. These materials have various viscosities and flow rates that may vary with temperature.

There are two principle ways in which liquids are applied to the hair to be treated to obtain coloring of substantially all of the hair. One may be called an all-over application process of which coloring shampoos and rinses are typical examples. This method has been used satisfactorily for certain types of hair treating materials which are relatively nonirritating to the scalp, nondamaging to the hair and which do not have critical time periods that must be observed in order to get satisfactory results. Many hair treating materials do not satisfy these criteria and are therefore applied in the other method which may be called a step-wise or progressive method, i.e., the treating liquid is applied successively or progressively to small sections of the hair until the operation of treating the entire head of hair therewith has been completed. Various methods are already known for effecting this progressive application of a hair treating liquid to the hair. Beginning some four decades ago color was first applied with a swab. This was followed by the bowl and brush method in which the liquid to be applied was prepared in an open bowl and applied by means of a brush that was dipped into the liquid in the bowl and then moved to the section of the hair that was ready to receive the liquid where it was applied by brush strokes primarily in the direction from the scalp toward the ends of the hair. A more rapid method of applying hair treating liquids to the hair came with the use of a squeeze bottle having an externally threaded cylindrical neck on which a sectioning and dispensing attachment or applicator is screwed. This attachment comprises a body having an internally threaded cylinder or collar to be screwed on the neck of a squeeze bottle projecting outwardly in one direction and an elongated projection extending outwardly in the opposite direction, e.g., a frustrum of a cone or the like, having a tapered passageway for liquid passing completely through it. The hollow projection is referred to in the art variously, e.g., as a tip or knife. A bottle and attachment of this type is shown in Levie U.S. Pat. No. 2,794,440 for hair waving solutions. An operator is able to form successive sections of a customer's hair with such a device by holding the squeeze bottle as a handle and using the tip in the same way that a rattail comb is used, although Levie shows the use of a rattail comb anyway. Such a section of hair, which may be about ¼ inch up to 1½, or even 3 to 4 inches, wide and ordinarily not more than about ⅛ inch thick, is referred to variously in the art as a lock, strand or tress of hair. After the operator has formed such a strand of hair in this way, it is held taut by one hand while the other hand squeezes the bottle to force a thin stream of liquid through the tip, e.g., onto the scalp along the near part line of the strand at the area to be treated for touch-ups or along a strand or tress for overall treatment. The smooth tip of the applicator is worthless as a spreading device, or as a device to pick up excess dripping material near the hairline, so most operators effect the spreading of the liquid through a tress by the thumb and fingers and through the root areas on touch-ups and pick-up of excess liquid by the thumb of the hand that holds the strand of hair being treated.

These methods produced heads of hair of uniform color that at one time were very fashionable whereas today women desire a more natural appearing head of hair which is characterized by somewhat darker shades underneath near the nape of the neck, somewhat lighter shades near the face and highlights on the surface, particularly when the hair has been exposed to sunlight. In order to accomplish this result on heads of virgin hair which lack the highlights and on heads of tinted and toned hair, various ways of dimensional hair coloring, hair painting, streaking, frosting, tipping and the like have been proposed. In these processes the use of cotton swabs and brushes have been suggested for transferring the thick, viscous bleach material, e.g. a mixture of about 2 parts Basic White with 1 part by volume of hydrogen peroxide solution of variable strength, to the portions of the hair to be treated. In hair painting or streaking, for example, the process of the prior art comprises the parting of the hair, combing it down and then painting the viscous or pasty material in narrow spaced stripes on the surface of the hair from about one half inch away from the scalp down at least on that portion on the hair which is supported by the head, starting near the front adjacent to the face and proceeding toward the back of the head. Since the viscous bleach material is too thick to flow and only surface hairs have it applied to them, the streaks developed by this process are lost to view if the hair is parted in a location different from that where it was parted for the painting operation. Another suggested procedure was to part off strands about ½ by 1 to 2 inches, protect the hair behind each strand with heavy cream and/or cotton, placing a piece of foil under the strand and applying the viscous mixture to the strand starting about ½ inch away from the scalp and stopping short of the ends if they are damaged. After developing until the strands have reached the golden blond stage, the viscous material is reapplied to the portion of the strand previously painted and to the ends until the hair is light enough when the action of the bleach is arrested. In hair frosting and tipping the prior art has taught parting off sections about an inch square, picking up tiny strands of about a dozen hairs each from a section with a fine rattail comb by a darning movement, laying them on a piece of foil placed over the remainder of the hair in the section, brushing the viscous bleach material on the tiny strands, folding the foil around these painted strands, and continuing this procedure in checkerboard fashion until the desired area has been treated. After a period of time sufficient to develop the desired color in the painted strands the action is stopped by rinsing the strands individually in soapy water. Toner was applied if desired before shampooing to remove the material. For so-called blonde on blonde hair styling it was suggested to develop a desired blond shade with toner on the whole head of hair, then section out spaced strands about ¾ inch square in checkerboard fashion to cover the entire head, each strand being wrapped in aluminum foil, whereupon the second toner was applied to all the hair not covered including the base of the wrapped strands, allowed to develop about half an hour, then carefully rinsed and shampooed before removing the foils. The present invention provides methods for transferring and spreading such materials, for controlling the area on which the materials are spread and, if desired, also for parting or sectioning the hair for the spreading operation which overcome the disadvantages of the methods proposed heretofore. The packages of the invention provide in a single container all the material necessary for carrying out a given method.

DESCRIPTION OF SPECIFIC EMBODIMENTS OF THE INVENTION

The methods include several embodiments of the invention of selectively altering hair color to achieve variegated hair.

One embodiment is to simulate the natural highlights found in hair particularly of young people and people who have exposed their hair to sunshine. The process is of particular value in treating hair, that has been colored, e.g., by tinting or toning, which tends to have a comparatively uniform hue or cast. It can also be applied, however, to virgin hair which does not have sufficient highlights to satisfy the person involved.

Generally speaking, the processs should be applied to hair that has not been prebleached because prebleached hair, unless restored, is usually sufficiently damaged in the prebleaching operation that breakage may occur if the present process were applied to it.

The natural highlight treatment may be carried out in either of two different sequences:

1. The operations comprising the natural highlights treatment as hereinafter described may be carried out on the hair in whatever condition it may be, e.g., virgin, tinted, toned, frosted, painted, streaked, etc. (remembering the caution mentioned above about possible breakage in applying it to prebleached and unrestored hair). After the natural highlight treatment has been completed, any color that may be desired may be applied to the whole head of hair. The application of color at this stage does not extinguish the differences in color produced by highlight treatment so that the natural appearing highlights persist through the color treatment and are readily visible after coloring.

2. The hair may first be colored to the desired shade or hue and then the natural highlight treatment be carried out, with or without the operation of additional coloring of the lightened portions thereof.

The natural highlight treatment involves as a first operation the random application of a hair color altering material, usually a bleach material, to the surface or top layer of hair in an uneven manner. By "random" is meant that the application is not uniform or according to a fixed or regular pattern. By "uneven manner" is meant that the hair color altering material is applied more heavily or in greater thickness in some places than in others so that the color altering material will remain active for varying lengths of time depending on the thickness of the application. Thus, for example, where a fairly thin application of a paste made from a powdered bleach material such as BASIC WHITE and developer is made to hair, it may dry out within a few minutes, say three to five minutes, to such a dry condition that its bleaching action stops. A somewhat thicker application may continue to be active for another, say, three to five minutes (total six to ten minutes) whereas a fairly thick application may stay active for fifteen minutes or longer. This means that the degree of color change in the hair is different, depending upon the thickness or volume of material in contact with it. It is also a feature of the application of the hair color altering material that only a portion of the hair exposed to view (visible hair) is subjected to action of the hair color altering material. The random, uneven application of hair color altering material may be carried out in a number of different ways which will be illustrated by reference to a bleach material comprising a pasty mixture of a powdered bleach material, e.g., BASIC WHITE, and liquid peroxide developer, of about the usual consistency used in hair painting, hair tipping, hair frosting, and the like. One way to obtain the uneven application is to place about a tablespoonful of the paste on the palm of one hand and rub it with the palm of the other hand until the pasty bleach material has been spread somewhat unevenly over the palms and insides of the fingers of both hands. The bleach material is then brushed lightly over the surface of the hair which has been combed in the usual style in which it will be worn in a direction outwardly from the scalp toward the ends being a short distance away from the scalp so as not to bring the bleach material into contact with the skin of the scalp. The spreading operation is continued until as much of the surface hair has been coated with the bleach material as desired. Another way is to apply quite narrow strokes of the coloring material by a finger, brush, or the like along the hair in an outward direction from random positions on the head. Another way is to use both of these methods of application on the same head of hair. Another way is to use a comb to obtain substantially the same type of application as any of the three ways just described. Another way is to use a sponge, a piece of cloth, particularly a cloth having a nap such as velvet, terrycloth, and the like, or the like instead of the hands. Whatever the particular method of application may be, it is characterized by its random nature and its uneven amounts of the color altering material in different parts of of the head of hair. A second operation is to allow the bleach material to remain until the desired difference in color has developed between hair that has been contacted with the bleach material and the remaining hair. A third operation is to stop the bleaching action when the stage is reached by any suitable means, e.g., washing the bleach material from the hair. An optional operation thereafter is to apply color to the bleached hair, as desired, to give it any desired hue or shade different from that obtained by the bleaching operation alone. Other bleach materials, e.g., oil bleaches with or without activators, may be used in similar manner as more fully described hereinafter with similar results except that it is not necessary to avoid contact of the oil bleach with the skin of the scalp because the skin of most persons does not have an adverse reaction to an oil bleach whereas the skin of many people does have an adverse reaction to the strong bleach material consisting of the powdered bleach and developer.

The process also has useful applications in other situations where more than mere natural highlights may be sought. As one example, if a woman having naturally black hair has had it lightened to a dark brown color which she does not like and she desires a lighter brown, she may be satisfied, without subjecting the entire head of hair to a bleach operation followed by toning, by giving her a natural highlight treatment, particularly in the first manner described, which gives the appearance of a lighter overall color. As another example, if a woman is dissatisified with the color which has been applied to her hair because it is more red than she wants, she may be satisfied by subjecting her hair to the highlight treatment, again particularly in the first manner set forth, by which the surface hair is lightened to the desired extent, washed and dried, and then color applied with a drabber so as to obtain the desired brown shade without any red, or very little red. By this treatment part of the surface hair is not only highlighted with respect to the remainder of the hair but also given a desirable shade substantially free of red. As a further example, if a woman has a "gold band" that sometimes occurs in hair treating, it may be masked by the highlight treatment without subjecting all the hair and the scalp to strong bleach. The highlight treatment produces results in these situations that are highly satisfactory to a large percentage of the women having these conditions.

The natural highlight treatment as described may be carried out on heads of hair of any shade from very dark to hair that has been lightened to the fifth, sixth, or seventh stage, where the highlight process carries the hair affected thereby at least to the next lighter stage and thus produces the desired contrast for highlights.

A great advantage of the natural highlight method of the present invention is that it saves a woman who is dissatisfied with the color of her hair from being subjected to the stripping of color from the entire head of hair by a bleaching operation in order to get the desired result and instead undergoes only the very simple procedure of the natural highlight method.

In the natural highlight method there is a random, uneven application of bleach material to surface hairs without substantial penetration into underlying hairs, permitting it to effect the desired lightening action and then stopping its action, e.g., by removing it from the hair. This process imparts the same kind of highlights to hair that exposure of the hair to strong sunlight causes. The hair that has been bleached by this process may subsequently be colored to any desired shade by tinting or toning if the bleached color itself is not what is desired.

When the hands are used in the manner described to apply the paste or other material to the surface hair, they may be protected by rubber or plastic gloves. Instead of using the hands to obtain the relative thin layer of bleach material for spreading on the hair, a comparable random, uneven application of the material may be obtained on all or any desired portion of the top layer or surface of the hair by the means suggested, e.g., a brush of any desired width, a comb (preferably a large tooth type), a sponge, a piece of cloth, particularly cloth with a nap such as velvet, terrycloth, and the like. The novel feature of the natural highlight method is the random, uneven application of the color altering material to the surface or top layer of the hair only in order to obtain substantially the same appearance as natural highlights.

When the lightening material is applied to the hair in these and equivalent ways, there are some hairs visible from the outside in the area that has been treated which have essentially none of the material applied thereto, some surface hairs that have a very light application and other surface hairs that have enough of an application to effect full bleaching. After leaving the material on the hair long enough to bleach or lighten it as desired, its action is stopped as described, e.g., by removing it by rinsing or shampooing. The result is a variegated surface appearance much like the sun causes.

The process may be carried out in any of these ways by the person whose hair is being treated or by another person, e.g., a friend or a beauty operator in a salon. Moreover, instead of applying the material as described to the surface or top layer only, it may be applied to one or more under layers of hair as well as to the top layer by parting the hair at different levels, starting at the neckline, and keeping the hair above the part line out of the way as bleach material is applied to the surface hair in the layer below the part line, as described above, at each parting level.

While the foregoing procedure has been primarily described with the use of pastes made of powders such as BASIC WHITE which is an off-the-scalp type, on-the-scalp types of materials may also be applied by the technique described. On-the-scalp type materials include oil bleaches alone or with one or more of the following additives:

(a) Acclerators, e.g., Protinator to intensify the bleaching action.

(b) Colors, e.g., tints and toners, to impart color to the hair as well as to bleach it. If desired, the color may include a drabber to eliminate or reduce red pigment in the hair.

Another embodiment involves streaking the hair in depth by segregating tresses on a plurality of areas of substantial depth and applying thereto a liquid capable of altering the color of the hair, e.g., a flowable lightener, preferably by use of a fountain spreader. After permitting the liquid to effect the desired color alteration the action thereof is stopped.

A further embodiment comprises imparting a uniform shade of warm brown or lighter, parting the hair as it will be worn, selecting the parts to be lighter and the parts to be darker and tinting the latter or lightening the former. The invention also contemplates use of three toners to selected parts of the hair, either prebleached or virgin. Interesting effects are also achieved by segregating a tress from the remainder of the hair by making triangular and other polygonal partings at the scalp with the base or the apex of the triangle or polygon at a focal point on the scalp, e.g., the face line or a part line, and imparting a darker or lighter shade either to the tress thus formed or to the remainder of the hair. Two or more such polygonal tresses may be formed, if desired. The hair can be ratted before application of bleach as described to give control to fine hair, stronger support to be smoothed surface hair, and provide more of a barrier to penetration of the bleaching material to the scalp, if desired.

Great versatility in hair style can be achieved in accordance with other embodiments of the invention by selective hair coloring as now described.

In one embodiment the steps are:

1. Select an intermediate area of hair extending back from the hairline at the foreghead toward the crown, the location and size of which should fit the facial features including size of nose, height of forehead, etc., which is to remain the darker shade of the mass of hair, whether virgin, tinted, toned or bleached. Segregate the hair in this area from the hair at each side of it by parting lines. The length of the two parting lines from front to back is not critical but in general they should be at least about one fourth of the distance from the hair line to the crown and may extend all the way to the crown but preferably their length is not more than about half way back. The distance between the two lines is not critical and may be, for example, from about ½ inch to 1½ inches apart. The lines may be parallel to form a rectangular area or divergent to form a trapezoidal area.

2. Run a parting line from the inner end of one of said side parting lines downwardly at any desired angle to the part line. One desirable effect is achieved by running this second part line toward the hair line at the face at an acute angle to the parting line. To achieve this effect, the practical upper limit of the angle is that which intersects the sideburn at the upper part of the ear. Other interesting effects are achieved if the second part line forms a right or even obtuse angle with respect to the first part line. The tress thus formed is a polygonal tress.

3. Lighten the polygonal tress, i.e., the triangular, rectangular or trapazoidal tress thus formed, e.g., by bleach with an off-the-scalp type, e.g., the paste of BASIC WHITE and developer, an on-the-scalp type bleach, e.g., ULTRA BLUE, SUPER BLUE, or the like, or a tint or a toner or the like. An advantageous procedure is to use a viscous paste of BASIC WHITE or the like first, starting its application far enough from the scalp to prevent contact thereof with the scalp, and then after removing it apply an on-the-scalp bleach to the untreated root area to lighten it also.

4. Repeat Steps 2 and 3 on the other side of the selected area. The size and shape of the tresses on the two sides may be the same or different.

A modification of Step 2 and/or 3 is to interrupt the triangular or other area part way down with one or more bands similar to the one formed in Step 1 which results in one or more upper trapezoidal areas and a polygonal, e.g., triangular, rectangular or trapezoidal area at the bottom.

Instead of lightening the polygonal areas with respect to the selected area between them, which may have parallel or nonparallel sides, they may be darkened, but preferably they are lightened. They may also be tinted or toned after being lightened.

This arrangement of variegated areas permits the hair to be combed in four entirely different styles:

(a) No part, with the hair combed back, which gives basically a shaded blond with a dark central streak.

(b) A part high up through the lighter polygon on one side with hair combed sideways in both directions away from the part which gives basically a blond headed effect from the front.

(c) A part about ¼ to ⅓ way down the lighter polygon on one side with the hair combed sideways in both directions away from the part, which gives interesting streaked and graining effects on the side of the head above the part. Thus at the face line there is a lower layer of blond hair from the polygon on the side opposite the part, an intermediate layer of dark hair from the central area and an upper layer of blond hair from the portion of the other polygon above the part.

(d) A center part through the dark area with the hair combed sideways in both directions away from the part, which is basically a darker blended effect with blond streaks at the sides under the upper layer of darker hair.

In the event that the polygonal areas are darkened instead of lightened, these color effects described are reversed.

In another embodiment the steps are:

(1) Lighten a slim tress at the front hair line or at a part line with a bleach, tint, toner or the like. Preferably this tress, referred to sometimes as a lead tress, is kept segregated from the hair around it in any way, e.g., by a clip, by shaping it into a pin curl, by a piece of cotton, plastic, foil, or the like.

(2) Part a rectangular tress back or down from the slim, lighter lead tress which is somewhat wider than the lead tress and of any desired length. Lighten the rectangular tress in any of the ways mentioned in Step (1).

(3) Part a still wider area, e.g., square, at the end of the rectangle remote from the lead tress and lighten it in any of the ways mentioned in Step (11 ).

If desired the order of the three areas from the hair or part line may be reversed.

More than one such tripartite area may be produced in a head of hair, if desired. In case two or more such areas are provided they may be connected, if desired, by one or more such leader tresses which forms a bridge between them. Similarly a single area may have one or more leader tresses in any desired locations.

This arrangement of variegated areas also may produce a plurality of special effects by varying the manner of parting and combing the hair which are turly spectacular and permit the woman many choices of different attractive hair styles.

The foregoing embodiments giving very verstaile hair styling and describing the effects of the method have been described with reference to lightening selected areas of darker hair but, as noted, the steps may be applied to darkening of selected areas of lighter hair which is desirable in case a woman who has become very blond wishes to return in part, at least, to a darker color of hair.

A further embodiment of variegating hair which is particularly useful with long hair comprises segregating from surrounding hair, e.g., by parting, a rectangle of hair starting near a leader at a hair line or part line or other focal point in the head of hair and going away from the leader for as small a distance as about ½ inch up to as far as desired. In case the hair is streaked by painting, which is a surface coloring only, a tress of hair that has been painted may serve as the leader. The leader is laid down opposite a parting line between it and the rectangle, which may be directly opposite or adjacent to the leder, so that when the leader is laid down over or adjacent to the rectangle it will follow the rectangular strand. In the event no leader is already present, it will be provided as described above. The width of the rectangle may be about the same as a painted strand or other leader, or it may be wider or narrower as desired. This rectangular strand is then altered in color with any desired material such as bleach, tint, toner or the like so as to be lighter or darker than the mass of hair around it, preferably lighter if it is to be adjacent to or underlie a light streak and vice versa. A long rectangle may be divided into sections, some light and some dark, some wider and some narrower. One or several of such areas may be produced. Where the resultant areas comprise the leader, a wider rectangle behind it and a still wider square the combined areas are the same as the embodiment previously described which may therefore be considered a specific example of the embodiment just described. The words "rectangle" and "square" are not to be strictly construed but rather as general indications of the shapes of the tresses so described at the scalp.

In altering the color of the leader and/or rectangle or other areas behind it any desired method and/or means for segregating it and/or them from surrounding hair may be used, such as a roll of cotton along the parting line, protective cream on the surrounding hair, protective sheet such as foil, e.g., aluminum, plastic or rubber sheet overlying the surrounding hair, clamps on the surrounding hair, ratting near the scalp, as at the base of a leader, and the like. If the leader has been provided by bleaching with an off-the-scalp type bleach paste, the adjacent rectangle is also preferably lightened by the same material, in which case the root area for about one half inch would be left free of the bleach material so as not to damage the scalp. This root area, if desired, may be lightened by an on-the-scalp type bleach. The invention contemplates this two step process.

The method of extending surface streaking or other small leaders into the rectangle below or adjacent to the leader when it is laid down, as described, may be termed inner streaking or in depth coloring to distinguish it from the surface coloring obtained by painting.

Hair variegated by lightening selected areas in the manner described need not be maintained or touched up every month. If new growth is obvious after a month, the new growth may merely be tinted the color the hair was previously tinted. It would usually be three or more months before it would be necessary to extend the lightened variegated areas toward or to the scalp again. It is not necessary to start all over again from the beginning with the described procedures, as recommended in the prior art for some variegated coloring, e.g., blonde on blonde.

Hair variegated by darkening the selected area instead of lightening it, usually requires touch up each month or so by extending the darkened strand or strands to the scalp in the same manner already described.

In any of these methods of variegating the hair in depth, surface streaking may also be carried out in known manner on other parts of the hair not variegated by the in depth method, and, if desired, on parts that have been variegated in depth.

A method of streaking hair internally comprises parting a section of any desired thickness, e.g., about an inch, at the nape of the neck and holding up the hair above the parting line in any of the desired ways, e.g., pins, clips and the like. Then apply streaks of color altering liquid to the hair below the parting line by a downward motion. The color altering liquid may be an off-the-scalp bleach painted on the surface or a tint, a toner, an on-the-scalp bleach, or the like that is applied in any desired way. The viscous bleach materials which can be applied to give sharper dividing lines are not essential in this method. It is not necessary that all the streaks across a section be made with the same material. Thus, for example, one or more of the streaks may be made lighter while one or more other streaks are made darker than the color of the hair being treated, whether virgin or precolored. Next part a section above the first section which again may be of any desired thickness and treat it in the same way, staggering the position of the streaks in a sort of checkerboard fashion, if desired. The lower section may be isolated from the second section, if desired, by a roll of cotton, a protective sheet of plastic, rubber, fabric, foil or the like, a protective cream or the like but such protective measures are not essential. A roll of cotton is better in some cases than smooth material like a plastic sheet in that hair containing the color altering material tends to cling to cotton and thus stay where put and prevent unwanted movement and contact with other hair. A third and even more sections may be parted and treated in the same matter until the crown of the head is reached. Then the sides of the head may be treated in the same manner until the crown of the head is reached and the internal streaking has been applied to the whole head of hair. The over all effect of this treatment is somewhat analogous to frosting but without the pain of pulling strands of hair through perforations in a protective cap.

A variation of the process of frosting just described is to lift successive strands from the section of hair and apply the color altering liquid to each strand while segregated from all other hair and then protecting the other hair around it as it is laid down by any suitable means such as protective sheet of suitable material, a cotton roll, a protective cream, or the like.

It is not necessary to carry out this sectioning method over the entire head unless it is desired. Thus if a tipping rather than frosting effect is desired, the operation may be confined to the sides some two or three inches back from the front hair line. The invention contemplates not only altering the color of the hair being treated in selected areas to a lighter shade but to darker shades also.

The methods of coloring hair described above have been concerned principally with the coloring of women's hair which has become acceptable and fashionable. Men have generally not colored their hair, either to change it from its natural color or to eliminate all of part of the gray hair as it develops but the attitude of a number of men is changing in this regard and there is a developing demand for products for and methods of coloring men's hair.

The structure and properties of hair are not different on men and women. Accordingly hair treating materials such as bleaches, tints, toners and the like which are effective on women's hair may be used on men's hair. There are differences, however, in the requirements for packages of hair treating materials for men, which form the basis for this aspect of the present invention, from packages of such materials for women which are known in the prior art. These differences derive largely from the different results desired by men and from the relatively short hair worn by most men as compared to the longer hair worn by most women. Coloring of men's hair, in general, has for its objective the partial or full restoration of the hair to the natural color so as to make him look younger naturally. If a man's hair is just beginning to gray he may prefer to have it as is because a little gray is considered to give a man a look of distinction. On the other hand, if a man's hair is predominantly gray, the general objective would be to restore at least most of it to the natural color, leaving at most only enough of the gray, if desired, to give him the look of distinction. Moreover, in coloring men's hair it is necessary to make provision not only for hair on the head but for hair on the face also, i.e., eyebrows, sideburns, moustaches, beards and the like.

Colorless lotions are available on the market which are advertised as working for all hair colors to change gray hair of men and women to natural color gradually and subtly by applying the lotion to the hair at the scalp. Daily applications are recommended by the manufacturer until the hair reaches the desired shade and thereafter weekly or more often as necessary to maintain the color. The effect of treating the hair with such a material is to coat the cuticle, resulting in a dull, unnatural appearance which is far less desireable than the appearance of hair that is colored by a penetrating dye that colors the cortex. The packages of the present invention do not contain a lotion of this type nor do the the methods of the present invention utilize such a lotion.

Packages of hair coloring materials for men embodying the present invention differ significantly, as will be described hereafter, from packages for women but they contain known lotions of of the types used for coloring women's hair which will now be identified.

One type of known hair color lotion that has previously been used only for women that may be used in masculine appearing packages of the present invention has, by reason of a semi-permanent hair dye therein, the property of penetrating the cortex of and coloring gray hair only and, when properly chosen as to color and applied as instructed to all the hair, restores the entire head of hair to the original natural shade. The effect lasts some four to five weeks. The composition may contain a shampoo ingredient that causes the liquid to foam when the lotion containing the dye and shampoo is worked into the hair. The color develops in the hair over a period of about (30) to (60) minutes depending upon the ambient temperature. By covering the hair after working up the lather, e.g., with a plastic cap, body heat is retained in the wet hair better than when no cap is used, enabling the desired color change in the gray hair to be developed in about 30 to 45 minutes.

Another type of known hair color lotion that has previously been used only for women and that is contemplated for use in masculine appearing packages of the present invention contains a semi-permanent dye that imparts a silvery color to gray and white hair and banishes the yellow cast frequently associated with graying hair. The composition may contain a shampoo ingredient and it may be applied in the same way as the lotion that restores gray hair to its natural color. The silvery color develops more rapidly when a cap is put over the wet hair after working the lotion into a foam through the hair.

Masculine appearing packages of each of these types of lotions may include, as do the feminine appearing cartons of each product in addition to a bottle of coloring lotion, one or more of the following: a plastic cap to go over the head after the lotion is worked into a lather, a pair of plastic gloves and/or a container of creme after-rinse to apply when the foamed lotion is rinsed from the hair.

Semi-permanent dyes of both types, i.e., (1) the type that restores gray hair to its natural shade without affecting the hair that has not turned gray, and (2) the type that imparts a silvery color to gray and white hair, may, as stated above, be used in the method and packages, of the invention for coloring men's hair on the head and on the face. Permanent dyes of the types heretofore used on women's hair including tints and toners may also be used in the method and packages of the invention for coloring men's hair. The method of using these coloring liquids is to apply sufficient of the liquid chosen for use to the hair to at least most of the hair and permit it to effect the desired color change before stopping its action. When the liquid is a tint or toner it is preferred to use a non-lightening fixative and to presoften the hair without substantial lightening by use of a presoftener to made the gray hair more receptive to the tint and toner. Special precautions are necessary in applying lotions containing these dyes, which may also contain shampoo ingredients to work up a lather as the lotion is worked into the hair, to eyebrows, sideburns, moustaches and beards to prevent the lotion from getting into the eyes, the mouth and the nostrils. A preferred precautionary measure comprises spreading a generous layer of a protective cream that does not become runny at skin temperature to the skin adjacent to the hair line where flow of the hair treating liquid is undesireable, e.g., around the eyebrows and moustache, in front of the sideburns, at least near the eyes and mouth and above the beard. This layer of cream is enough protection in many cases but, if desired, a roll of cotton can be placed over the layer of cream around the eyebrows and moustache, in front of the sideburns and/or above the beard. The cream serves to hold the cotton roll in place by adhesion and together they effectively prevent the coloring lotion from flowing from the hair to which it is applied into the eyes, mouth or nostrils. Some coloring solutions used on women's hair have a strong odor, e.g., an odor of ammonia, that is unpleasant if inhaled, particularly through the nostrils. While it is preferred to use solutions that are free of such unpleasant odors, even the odorous type can be used satisfactorily if the nostrils are closed during application of the lotion to the moustache, e.g., by a thumb and finger, a spring clamp, or the like. Another precaution that is important to observe in working on men's hair is that off-the-scalp type bleaches for removing color may be impracticable if the hair is short, in which case any bleaching of the hair may need to be done by the use of on-the-scalp types, e.g., oil bleaches.

The word "package" is used herein to mean a compact unitized assembly to perform a specific function. In some cases the package of the invention may be a container and its contents with a label having thereon the instructions for use of the contents, the trade mark and/or trade name and other matter giving the package a particular appearance. In other cases the package of the invention may include an outer carton or box of cardboard or the like having on the outer surface the trade mark and/or trade name and other matter giving the package a particular appearance having within it a container (and optionally other devices) and the printed instructions for use which may be on a label of a container or on a separate leaflet, booklet or the like. A masculine appearance to the package may be imparted, for example, by the use of a trade mark or trade name containing the word Mr. or Sir and/or by the use of the picture of a man's head, torso, and the like.

One article of manufacture embodying the invention is a masculine appearing package containing a sufficient quantity of lotion comprising semi-permanent coloring material that has the property of restoring gray hair to its natural color for a man's hair of average length and printed instructions for its use by and/or on men to remove all the gray or only selected portions thereof so as to retain some gray. The lotion may also contain a detergent.

Another article embodying the invention is a masculine appearing package containing a sufficient quantity of semi-permanent hair dye that has the property of imparting to gray hair a silvery appearance and of eliminating a yellow cast that frequently accompanies graying hair for a man's hair of average length and printed instructions for its use by and/or on men. The lotion may also contain a detergent.

A further article embodying the invention is a masculine appearing package containing a rinse of the same type now sold in feminine appearing packages for women. Such weekly rinses for women have to be applied after each shampoo and it is customary for a woman to apply such a rinse to all her hair following a shampoo. These rinses merely coat the cuticle, requiring repetition after each shampoo. The embodiment of the invention containing a rinse is an article of manufacture comprising a masculine appearing package containing a suitable quantity of such weekly rinse for a man's hair of average length and printed instructions for its use which may include overall as well as selective application so as to retain some gray for the look of distinction.

The masculine appearing package in each of the foregoing articles may comprise only a container for the contents and a label having the instructions and other material giving it the masculine appearance printed thereon or it may include a carton having the material that gives it the masculine appearance printed on it and containing a bottle of the lotion, a label or separate sheet containing instructions for use, a plastic cap to put over the hair after applying the lotion and working it through the hair and into a lather and a pair of plastic gloves.

The invention also contemplates packages of each of the two described types of simi-permanent dyes in non-flowable form, e.g., in collapsable tubes in the form of a gel instead of flowable liquids by including a gelling agent in the formula, or in stick form as a crayon with a solidifying agent. Gelling and solidifying agents for this purpose are known in the art, a satisfactory one being a cross-linked interpolymer of an unsaturated fatty acid and a vinyl or crotyl compound (cf. 2,798,053) which will gel and solidify a solution of the dyes when added in appropriate proportions thereto.

The appearance of the package for the gelled product may be masculine or feminine and may consist of the tube and contents only with instructions printed on the tube or include a carton for the tube, printed instructions on the carton, the tube or a separate sheet, and any desired accessories such as a cap, gloves and/or creme rinse.

The invention also contemplates improvements in packages for powdered bleach such as BASIC WHITE.

BASIC WHITE is a very fine powdered material that is hygroscopic and therefore must be protected against humidity in the atmosphere during storage. It requires the admixture with it of a developer, generally a peroxide solution, in order to form a paste which is in a condition for spreading on the hair by a brush in the manner described hereinabove. The current practice as exemplified by a kit for frosting or tipping a woman's hair is to produce and seal a carton containing a bowl or mixing vessel, an air-tight can of BASIC WHITE, a plastic squeeze bottle containing the developer and having a moisture-tight cap screwed on the neck thereof, a spoon or the like to serve as the mixing implement when the powder and the developer are mixed together in the open bowl, a perforated cap, two plastic hooks and a sheet of instructions with a double sheet of plastic adhering to the back side in which a pair of gloves is formed by heat sealing the periphery and weakening the sheet around them so that the gloves can be pulled loose to wear during application of the mixture of the BASIC WHITE and developer to the hair pulled through the perforations in the cap. The instructions warn against inhaling the cloud of powder which inevitably rises from the mixing bowl where the can is emptied into it and when the powder is first stirred to blend it with the liquid developer.

For the beauty shop use BASIC WHITE is sold in much larger quantity than the unit size in a larger plastic bag inside a can that may be opened and closed to minimize contact of the atmosphere with the BASIC WHITE until it has all been used up by removing successive unit quantities. The problem of dust in the air attends the use of the powder when packaged in this way also.

The present invention overcomes these difficulties of the prior art by providing a thin, moisture-resistant plastic container in which the bleach powder is packaged in unit quantity, i.e., just sufficient for a single application for the purpose for which the package is intended. This plastic container has a passageway or opening through the wall thereof large enough to admit the introduction of the liquid to be mixed with the powder and also large enough for discharge of the pasty product resulting from the mixing of the powder and the liquid developer. The plastic bag, after receiving its charge of BASIC WHITE powder, may be closed in any desired way to avoid spillage of the powder in normal handling between filling and use. It is placed within a can which may be of either type presently used for shipping BASIC WHITE described above, i.e., of the single-use type for home use and the multiple-use type for beauty salons. The present invention contemplates packages comprising cans of both types, i.e., a smaller type containing the single charge of powder in the plastic bag and a larger type containing many such bags which may be removed one at a time for use in a beauty salon.

A package for a single use preferably comprises a carton, a can containing the powdered bleach, e.g., BASIC WHITE, in a plastic bag, a bottle of developer and optionally a cap, gloves and instructions but it is not necessary to include the other implements normally contained within such a package, e.g., the mixing spoon and the mixing bowl.

A package for multiple use comprises a can with a tight lid, e.g., a press-type lid, that can be lifted out with a lever to make the contents available for removal for use and then pressed back in the opening to minimize free contact of the atmosphere with the interior. In the can are many bags of the structure described herein, each containing a unit quantity of the bleaching powder. Developer may be separately packaged in single or multiple use containers.

If desired, the flexible-walled plastic bag used in the package of the invention may have a reinforcing ring secured thereto around the opening so as to make access to the bag by a brush easier than if the opening is simply a hole in the wall of the bag. Also such a ring may be threaded to receive selectively (a) a simple closure cap, (b) a cap that may be opened and closed by a pivoted tip having a discharge passageway through it, or (c) a cap having a discharge orifice. The discharge passageway and orifice in caps of type (a) and (c) are of a size permitting a stream or ribbon of BASIC WHITE paste to be dispensed through them when pressure is exerted on the bag directly onto the hair for hair painting, streaking, frosting, tipping, and the like. The caps of types (b) and (c) may include a brush adjacent to the discharge orifice to assist in painting the paste on the hair. When a dispensing cap of type (c) is used, the bag is referably closed for transportation by a simple closure cap and the threaded dispensing fixture or cap is included in the package to replace the closure cap for dispensing the paste. Just prior to use of the unit quantity of powder in a plastic bag of any of these types, the developer is introduced through the opening in the wall thereof into the bag where the powder is contained, which does not create any dust problem whatsoever. The opening is then closed in any satisfactory way, e.g., by twisting the upper end of the bag, by use of a closure cap or a valve cap, or by use of a cap with an open discharge orifice that is closed by a finger of the hand of the person who is mixing the ingredients, etc., while the contents of the bag are manipulated so as to effect thorough mixing. Since the mixing takes place in an air tight environment, no dust problem, spillage or the like occurs during the mixing and every bit of the original powder in the bag may be properly admixed with the developer. After manipulating the flexible-package sufficiently to effect thorough mixing, the pasty product produced in the mixing operation can be taken out of or expelled from the plastic bag for use in any desired way, e.g., for spreading on the palms of the hands to produce natural highlights, as described above, or it may be removed on a brush for applying to the hair to effect streaking, or it may be squeezed from the bag through the discharge orifice directly onto the hair for painting or into a bowl for any use to which such paste has been put heretofore.

The method of painting or streaking hair by squeezing a paste from a flexible bag through a discharge orifice directly onto the hair is not restricted to plastic bags of the types described above in which the paste is prepared in the bag by manipulation but can also be carried out by means of other devices which can be filled with a paste of suitable consistency that has been mixed elsewhere, e.g., in a bowl. An ordinary squeeze bottle with a cap having a discharge orifice of proper dimensions is an example of such a device. A pastry bag such as is used for decorating cakes with icing is another example of such a device. A pastry bag typically is a funnel shaped fabric bag having a discharge orifice with small end in which variously shaped nozzles can be placed from within and a filling opening in the large end through which the material to be extruded through the small end can be introduced by a spoon or the like. After a desired amount of the extrudable material has been put into the bag, the large end is closed by folding it over and holding it in this position as the bag is squeezed to extrude the material through the discharge orifice at the small end. The method of painting or streaking hair in accordance with this embodiment of the invention contemplates the use of any devices which can hold a charge of hair treating paste, wherever the paste may have beenn prepared, and dispense it as a stream suitable for direct application to the hair to be painted or streaked.

In some cases it may be desirable to provide a cushion for the strands being painted which may be accomplished by ratting the hair in the portion to be cushioned and then smoothing the surface to be painted. Ratting may also be used, alone or with other means for holding the hair in combed position. For example, if the hair is to be understreaked, e.g., if combed into a pony tail or bun at the crown of the head, ratting may be enough by itself to hold the hair in combed up position for a painting operation. Similarly at the hair line of the neck or face there are short hairs that are difficult to hold for painting where ratting may give the stability and control to the hair necessary for such painting.

If streaks are produced in the hair by sectioning or parting out rectangles at the scalp, e.g., from a part line toward the ear, and if the BASIC WHITE and developer paste is apppied through the rectangular tress of the hair, the streaked effect may be quite similar in appearance to that produced by painting only the surface, but the steak is not lost by placing the part in a different position on the hair. This method of producing streaks by lightening rectangular tresses in depth therefore has the advantage of more flexibility in hairdo than can be had with mere application to the surface of a tress as taught in the literature on hair painting.

The foregoing specific examples of the methods of invention are illustrative of the principles of the invention set forth hereinabove and in the following claims and are not to be construed as restricting the scope of the invention to the specific procedures of the examples.

Having thus described and illustrated the invention, what is claimed is:

1. A method of obtaining variegated colors in a head of human hair of substantially uniform shade which comprises selecting a focal point at the scalp that will be visible as the hair is to be worn, forming a tress by parting the hair to form a polygon at the scalp having a portion near said focal point, thereby dividing the hair into a portion to be lighter and a portion to be darker, applying liquid capable of altering hair color to a shade in the same color family as said uniform shade to one of said divided portions while preventing substantial creeping thereof into the other of said portions, and leaving it in contact with the hair long enough to effect the change of color of the hair to the desired shade; and then stopping the coloring action of the liquid on the hair.

2. A method of obtaining variegated colors in a head of human hair as set forth in claim 1 in which the hair has imparted thereto a substantially uniform shade of black or lighter and the color altering liquid is capable of altering the color to a lighter shade and is applied to the portions of the hair selected to be lighter.

3. A method of obtaining variegated colors in a head of human hair as set forth in claim 1 in which the hair has imparted thereto a substantially uniform shade of medium brown or lighter and the color altering liquid is capable of altering the color to a darker shade and is applied to the portions of the hair selected to be darker.

4. A method of obtaining variegated colors in a head of human hair of medium brown or ligher which comprises parting the hair as it will be worn, forming at least one strand of hair by a polygonal parting at the scalp starting at the part line, applying liquid to each such strand capable of lightening the hair and leaving it in contact with the hair long enough to lighten it to the desired shade and then washing the excess lightening liquid from the hair.

5. The method as set forth in claim 4 in which the polygon is a triangle having an apex at the parting line.

6. The method as set forth in claim 4 in which the polygon is a triangle having a base at the parting line.

7. The method of producing highlights in hair of medium brown or lighter color which comprises forming by parting a strand of hair of generally rectangular shape extending from the hair line at the face at least about one fourth of the way to the crown of the head and having a width within the range of about one half to one and one half inch, applying viscous spreadable off-the-scalp type bleach material through the strand from a starting position far enough from the scalp to prevent contact of the bleach material with the scalp to develop the desired highlight color in the strand, removing the said bleach material from the hair at such time and thereafter applying to said strand less viscous on-the-scalp type of bleach material from said starting position to the scalp to lighten it.

8. The method of selective hair coloring to provide versatility in hair styling which comprises:

(a) Segregating an area of hair extending back from the forehead by running a first parting line along each side of said area going back at least about one fourth of the way to the crown of the head.

(b) Running another parting line from the inner end of one of the first parting lines at one side of said area downwardly at an angle thereto to a hair line to form a polygonal tress and altering the color of said polygonal tress; and (c) Repeating step (b) on the other side of said area.

9. The method as set forth in claim 8 in which the color to which the hair in said polygonal tresses is altered is darker.

10. The process as set forth in claim 8 in which the color to which the hair in said polygonal tress is altered is lighter.

11. The method of obtaining variegated colors in head of human hair which comprises establishing a slender leader tress as a focal point, segregating said head of hair into two parts, one part comprising at least one tress of generally rectangular shape at the scalp starting near and going away from the leader tress and the other part comprising the remainder of the head of hair; applying to one of said parts a liquid capable of altering its color to the color of the leader tress, permitting the color altering liquid to effect the color alteration and then stopping the color altering action of the liquid.

12. The method of obtaining variegated colors in a head of human hair as set forth in claim 11 in which the tress of generally rectangular shape comprises a rectangle near the leader tress and a square remote therefrom.

13. The method of obtaining variegated colors in a head of human hair as set forth in claim 11 in which at least two spaced tresses of generally rectangular shape at the scalp are segregated and at least one slender bridge tress is provided in the hair between them.

* * * * *